US011408653B2

(12) United States Patent
Grabon et al.

(10) Patent No.: US 11,408,653 B2
(45) Date of Patent: Aug. 9, 2022

(54) HEAT EXCHANGER

(71) Applicant: Carrier Corporation, Palm Beach Gardens, FL (US)

(72) Inventors: Michel Grabon, Bressolles (FR); Charbel Rahhal, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 210 days.

(21) Appl. No.: 16/778,894

(22) Filed: Jan. 31, 2020

(65) Prior Publication Data

US 2020/0248936 A1 Aug. 6, 2020

(30) Foreign Application Priority Data

Feb. 4, 2019 (EP) ..... 19305132

(51) Int. Cl.
*F25B 39/02* (2006.01)
*F25B 39/00* (2006.01)

(52) U.S. Cl.
CPC ..... *F25B 39/00* (2013.01); *F25B 39/028* (2013.01); *F25B 2339/0242* (2013.01)

(58) Field of Classification Search
CPC ..... F25B 39/00; F25B 38/02; F25B 39/028; F25B 2339/0242; F28D 21/0017; F28D 7/16; F28D 2021/0071; F28D 2020/0069; F28D 2020/0073; F28F 9/00; F28F 9/0265; F28F 9/0263; F28F 9/026; F28F 27/02
See application file for complete search history.

(56) References Cited

U.S. PATENT DOCUMENTS 3,270,517 A 9/1966 Clark
5,836,382 A * 11/1998 Dingle ..... F28F 9/0273 165/160
10,132,537 B1 * 11/2018 Stamp ..... F25B 39/00
(Continued)

FOREIGN PATENT DOCUMENTS

WO 9803826 A1 1/1998

OTHER PUBLICATIONS

European Search Report for application EP 19305132.3, dated Sep. 3, 2019, 5 pages.

*Primary Examiner* — Henry T Crenshaw
*Assistant Examiner* — Kamran Tavakoldavani
(74) *Attorney, Agent, or Firm* — Cantor Colburn LLP

(57) ABSTRACT

A heat exchanger, such as a flooded evaporator, comprises a shell extending along a longitudinal axis (X), an inlet pipe and an outlet pipe, through which respectively enters (F1) and exits (F2) a refrigerant flow, and a bundle of pipes crossing the shell along the longitudinal axis (X), and comprising a refrigerant flow diffuser provided inside the shell downstream the inlet pipe, the refrigerant flow diffuser extending along the longitudinal axis (X) and comprising openings through which the refrigerant flows. The refrigerant flow diffuser comprises a moving element and a stationary element, the moving element being movable with respect to the stationary element under action of a pressure force (FP) exerted by the refrigerant flow so that the refrigerant flow going through the openings is adjusted and a differential refrigerant pressure between refrigerant pressure downstream (P2) and upstream (P1) the refrigerant flow diffuser is kept constant.

9 Claims, 10 Drawing Sheets

(56) References Cited

U.S. PATENT DOCUMENTS

| | | | | |
|---|---|---|---|---|
| 2011/0041528 | A1 | 2/2011 | Charbel et al. | |
| 2016/0377331 | A1* | 12/2016 | Su | F25B 39/00 62/526 |
| 2018/0187932 | A1 | 7/2018 | Miyoshi et al. | |

* cited by examiner

HEAT EXCHANGER

FOREIGN PRIORITY

This application claims priority to European Patent Application No. 19305132.3, filed Feb. 4, 2019, and all the benefits accruing therefrom under 35 U.S.C. § 119, the contents of which in its entirety are herein incorporated by reference.

BACKGROUND

The present invention concerns a heat exchanger such as a flooded evaporator.

Flooded evaporators for air treatment units (for example, chillers) comprise a shell in which a refrigerant gas circulates and which liquid phases are mixed. Refrigerant diffusers are used in flooded evaporators to evenly distribute refrigerant flow along the length of the shell.

Two phase refrigerant flow enters into the diffuser which in general has an elongated geometry with openings distributed along the length of the diffuser. The general aim of the diffuser is to facilitate an even distribution of the refrigerant by selecting openings geometry which compensate the variation of pressure differential between diffuser and evaporator shell which occurs along the length of the diffuser (from an entering section to the axial ends sections). In the entering section (directly downstream the inlet pipe, where the flow of refrigerant is close to its maximal value), which presents higher resistance (higher overall velocity and pressure) to preserve constant flow, smaller section openings are generally provided. Towards the axial ends of the diffuser (small flow and low pressure), openings are larger to preserve equivalent flow.

When the geometry of the diffuser is selected to optimize full load operation (maximal refrigerant flow), the geometry is not optimal for part load (lower refrigerant flow) operation. In a case of part load, overall refrigerant flow is low and resulting pressure difference between diffuser and shell decreases drastically which result in high variations of refrigerant flows in each individual opening. Flow distribution is therefore compromised, as it results in high flow in end section of diffuser, and low flow in medium section and also results in flow separation. This uneven distribution can also be observed in a case of operating conditions which are significantly different from reference conditions in which the diffuser has been optimized. For example, varying refrigerant pressures may result in varying refrigerant densities and subsequent varying refrigerant velocities departing from the usual refrigerant velocities the flooded evaporator is designed to handle.

SUMMARY

The aim of the invention is to provide a new heat exchanger in which the diffuser is better adapted to part load or operation conditions that do not correspond to the nominal conditions for which the heat exchanger has been designed.

To this end, the invention concerns a heat exchanger, such as a flooded evaporator, comprising a shell extending along a longitudinal axis, an inlet pipe and an outlet pipe, through which respectively enters and exits a refrigerant flow, and a bundle of pipes crossing the shell along the longitudinal axis, and comprising a refrigerant flow diffuser provided inside the shell downstream the inlet pipe, the refrigerant flow diffuser extending along the longitudinal axis and comprising openings through which the refrigerant flows. The refrigerant flow diffuser comprises a moving element and a stationary element, the moving element being movable with respect to the stationary element under action of a pressure force exerted by the refrigerant flow so that the refrigerant flow going through the openings is adjusted and a differential refrigerant pressure between refrigerant pressure downstream and upstream the refrigerant flow diffuser is kept constant.

Thanks to the invention, the geometry of the openings of the diffuser is constantly adapted under action of the refrigerant pressure force to maintain constant the pressure difference between the inside of the diffuser and the shell.

According to further aspects of the invention which are advantageous but not compulsory, such a heat exchanger may include one or several of the following features: The moving element is movable along a vertical direction, and the pressure force exerts upwards against a gravity force exerted on the moving element. In absence of refrigerant flow through the diffuser, the moving element is laid on the stationary element closing the openings. The openings are provided on the moving element and the stationary element in a shifted arrangement so that when the moving element is laid on the stationary element, the openings of the stationary element are closed by the moving element while the openings of the moving element are closed by the stationary element. The refrigerant flow diffuser has an angled shape, each of the moving element and the stationary element being formed by two angled plates. The diffuser comprises guides for the movement of the moving element. The guides comprise rectilinear slots, and the moving element comprises pins inserted in the rectilinear slots in a sliding manner

BRIEF DESCRIPTION OF THE DRAWINGS

The invention will now be explained as an illustrative example with regard to the annexed figures, in which.

DETAILED DESCRIPTION

Figure 1:
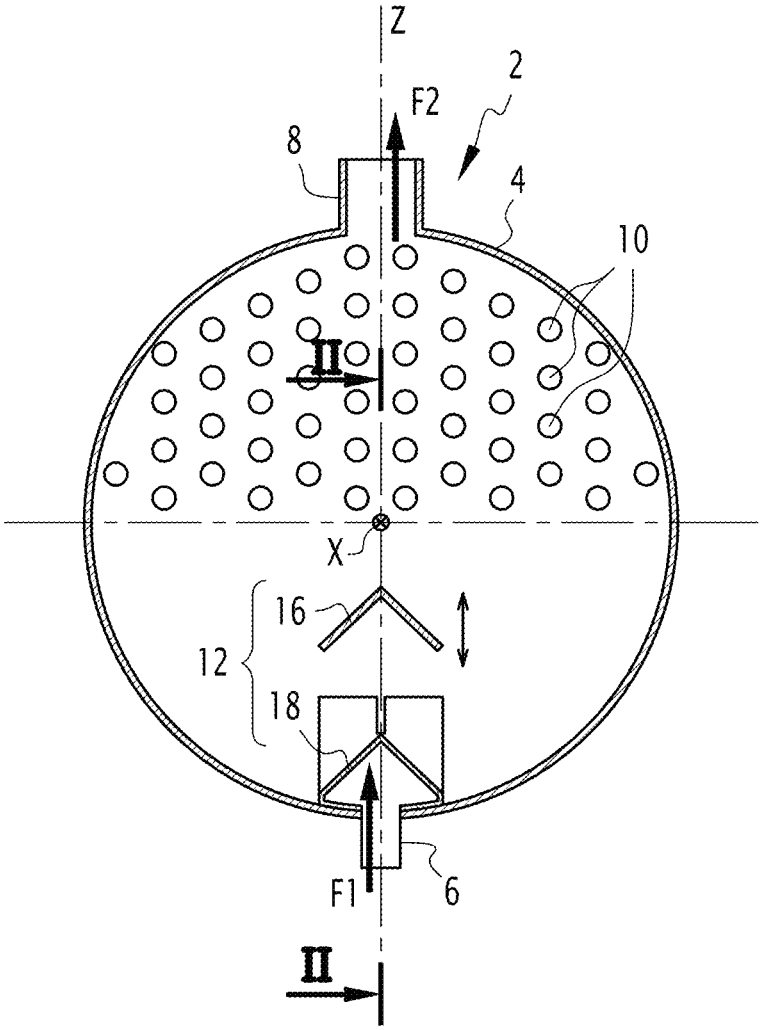
FIG. 1 is a transversal sectional view of a heat exchanger according to the invention in the form of a flooded evaporator.

FIG. 1 show a heat exchanger in the form of a flooded evaporator 2, for example for the refrigeration circuit of a chiller. The flooded evaporator 2 comprises a shell 4 extending along a longitudinal axis X. The shell 4 has a substantial cylindrical shape centered on an axis parallel to the longitudinal X.

The flooded evaporator 2 comprises an inlet pipe 6 and an outlet or suction pipe 8, through which respectively enters in the shell 4 and exits from the shell 4 a refrigerant flow along arrows F1 and F2 in FIG. 1. The flooded evaporator 2 also comprises a bundle of pipes 10 crossing the shell 4 along the longitudinal axis X. The bundle of pipes 10 is provided for the circulation in the shell 4 of a water flow to be cooled.

On FIG. 1, pipes 10 are represented filling most of the upper half of shell 4. However, other distributions of the pipes 10 are possible. In particular pipes, 10 can be absent from the upper quarter of shell 4.

Non represented pipes 10 are also be provided in the lower half of shell 4.

Figure 2:
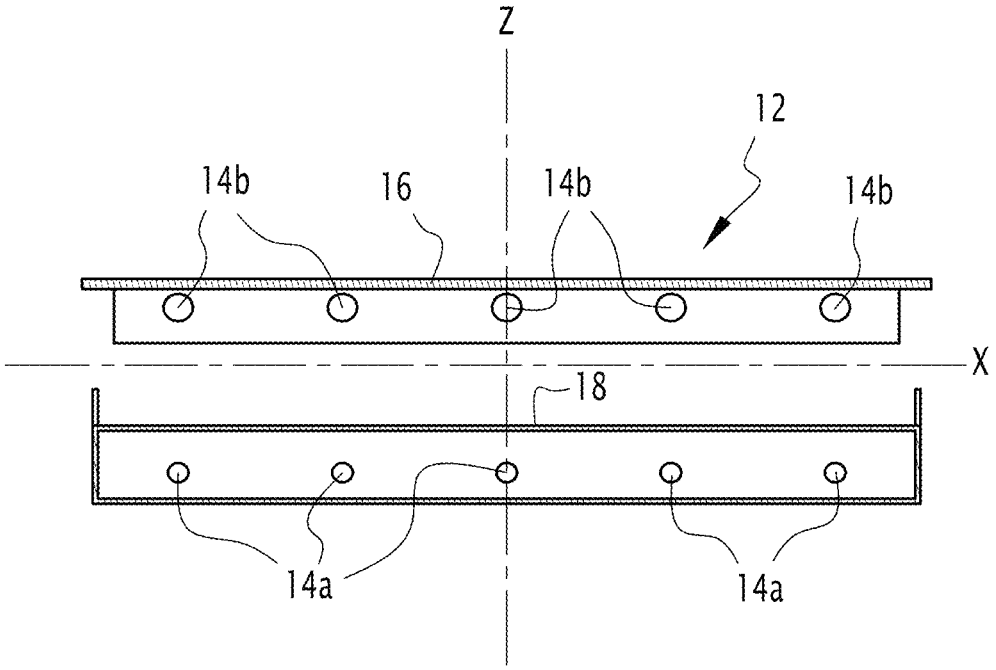
FIG. 2 is a sectional view along plane II-II of a refrigerant diffuser of the flooded evaporator of FIG. 1.

On FIG. 2, the flooded evaporator 2 comprises a refrigerant flow diffuser 12 provided inside the shell 4 downstream the inlet pipe 6, the refrigerant flow diffuser 12 extending along the longitudinal axis X and comprising openings 14*a* and 14*b* through which the refrigerant flows, along the direction indicated by arrow F1, through the diffuser 12. The aim of the diffuser 12 is to evenly distribute the refrigerant flow along the length of the shell 4, to obtain a constant refrigerant pressure along the longitudinal axis X.

Figure 3:
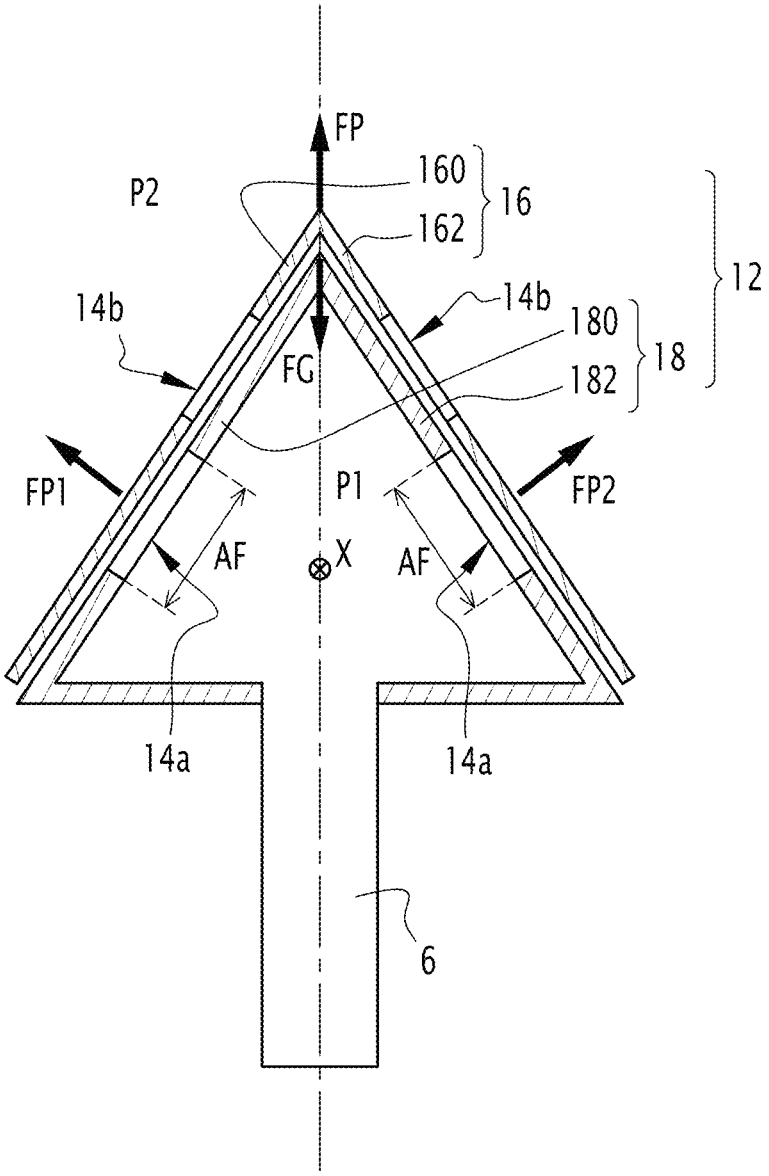
FIG. 3 is a transversal sectional view at a larger scale of the diffuser, with forces exerted on a moving part of the diffuser being represented.

As shown on FIG. 3, to overcome the above-mentioned issues related to part load or degraded working conditions, the refrigerant flow diffuser 12 comprises a moving element 16 and a stationary element 18, the moving element 16 being movable with respect to the stationary element 18 under action of a pressure force FP exerted by the refrigerant flow F1, so that the flow of refrigerant F1 going through the openings 14*a* and 14*b* is adjusted and a differential refrigerant pressure between an upstream pressure P1 and a downstream pressure P2 (with respect to the direction of flow through the diffuser 12) is kept constant.

At the outlet of the openings 14*a* of the stationary element 18, the refrigerant can go up through the openings 14*b* of the moveable element 16, then towards the shell 4. Alternatively, at the outlet of the openings 14*a* of the stationary element 18, the refrigerant can go below the moveable element 16, directly towards the shell 4

In the present example, the moving element 16 is movable along a vertical direction Z, which is perpendicular to the longitudinal axis X, and the pressure force FP exerts upwards against the gravity effect, which exerts a force FG on the moving element 16.

As represented on FIG. 3, the refrigerant flow diffuser 12 may have an angled shape. The moving element 16 is formed by two angled plates 160 and 162 and the stationary element 18 is formed by two angled plates 180 and 182, whereas the plates 160 and 162 form an angle which is equal to the angle formed by the plates 180 and 182. The stationary element 18 bears the openings 14*a*, while the moving element 16 bears the openings 14*b*. The openings 14*a* and 14*b* together form the openings of the diffuser 12.

The openings 14*a* and 14*b* are offset, so that when the moving element 16 is laid on the stationary element 18, the openings 14*a* are closed by the moving element 16 while the openings 14*b* are closed by the stationary element 18. As the openings 14*a* and 14*b* are offset, the refrigerant flow passing through the holes 14*a* faces solid areas of the plates 161 and 162 and exerts a pressure force.

As shown on FIG. 3, the refrigerant pressure flowing through the openings 14*a* exerts a force FP1 on the plate 160 of the moving element 16, on the left side of the diffuser 12, while the refrigerant pressure exerts a force FP2 on the plate 162 on the right side of the diffuser 12. The forces FP1 and FP2 are exerted on active surfaces AF of the plates 160 and 162. The active surfaces AF are the surfaces of the plates 160 and 162 that are exposed to the refrigerant flowing through the openings 14*a*. The active surfaces AF have the shape of the openings 14*a*. The plurality of openings 14*a* delimits a total active surface of the moving element 16 that corresponds to the sum of the surfaces of the active surfaces AF. In other words, the total active surface of the moving element 16 equals the added surfaces of the openings 14*a* of the stationary element 18.

The active surfaces AF being angled with respect to the vertical direction Z, the pressure forces FP1 and FP2 are angled, and the resulting force FP, formed by the sum of forces FP1 and FP2 projected in the direction Z, counteracts the gravity force FG.

Figure 4:
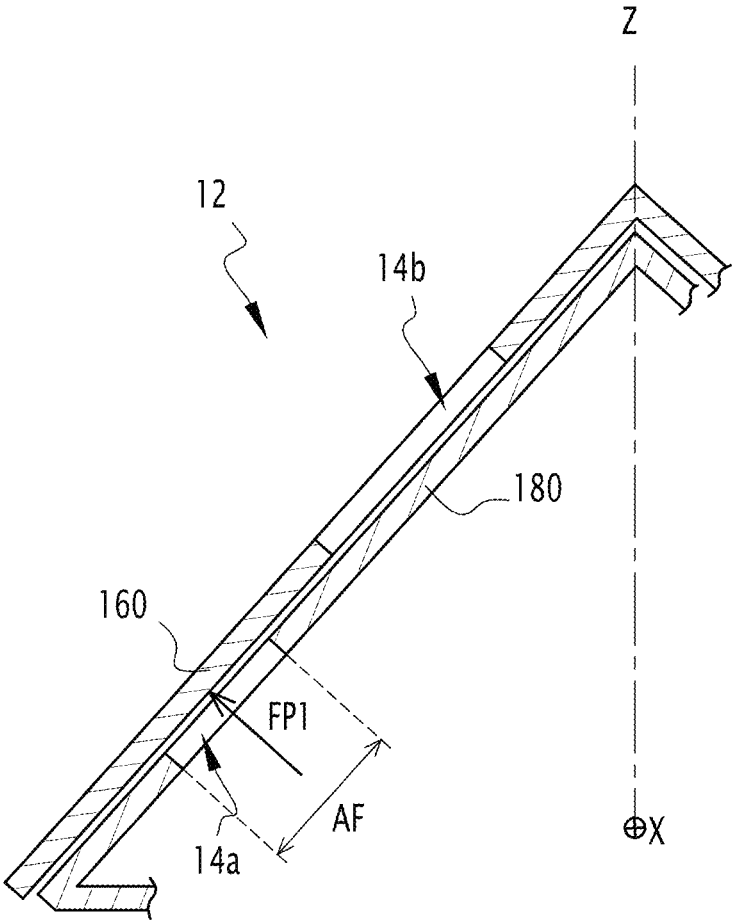
FIG. 4 is a transversal sectional view of a lateral portion of the diffuser, in a closed configuration.

When no refrigerant enters the diffuser 12, no pressure is exerted on the moving element 16, which then rests on the stationary element 18 under the effect of gravity. The diffuser 12 is therefore closed, as shown on the detail of the plates 160 and 180 on FIG. 4.

Figure 5:
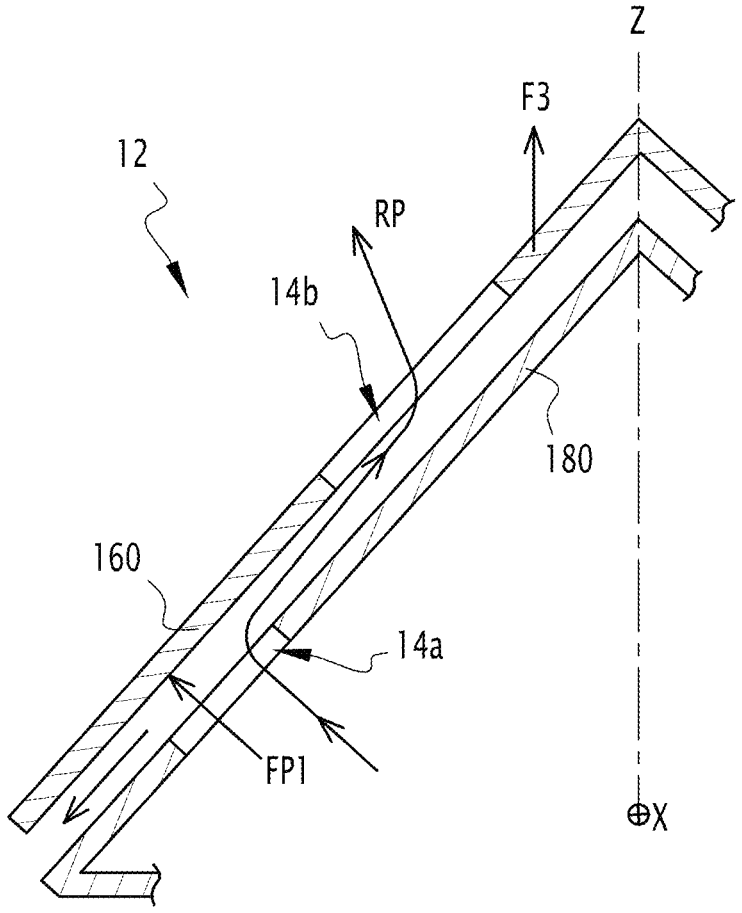
FIG. 5 is a transversal sectional view similar to FIG. 4, in a half-open configuration.

When refrigerant enters the diffuser 12 and pressure P1 starts to build, the pressure force FP increases and begins to counter act the gravity force FG, until the pressure force FP equals and overcomes the gravity force FG. The moving element 16 is therefore lifted along arrow F3, opening the diffuser 12 allowing refrigerant to flow along a refrigerant path RP through the openings 14*a* and 14*b* (FIG. 5). The moving element 16 is lifted until the pressure force FP and the gravity force FG are in balance, setting the pressure difference between P1 and P2.

Figure 6:
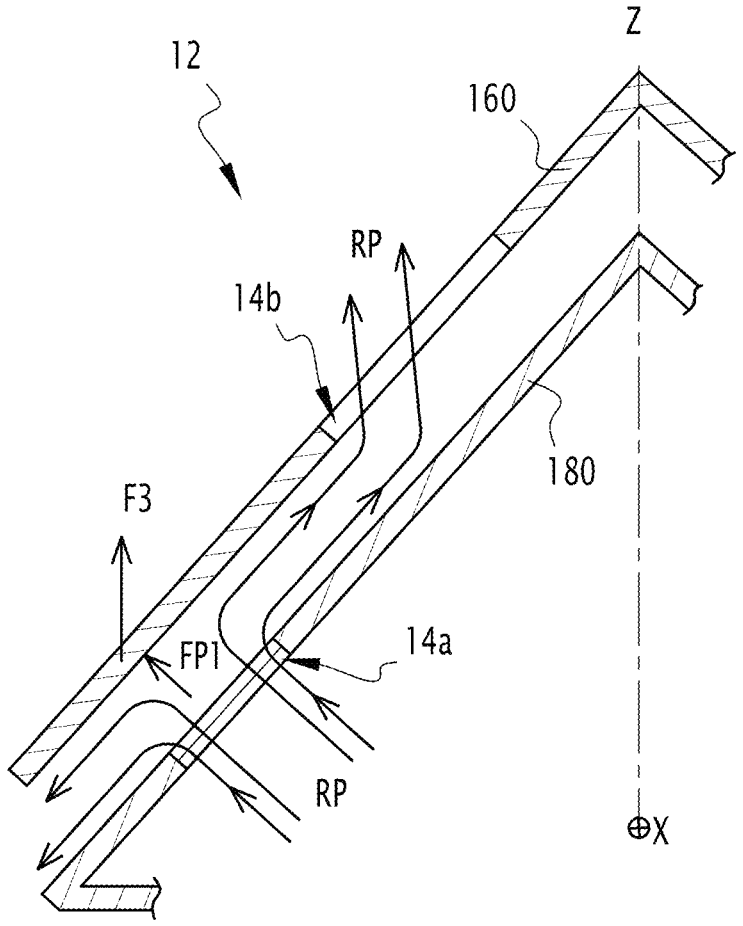
FIG. 6 is a transversal sectional view similar to FIG. 4, in an open configuration.

If the pressure P1 increases further, to maintain the pressure difference constant, the moving element 16 is lifted further until the balance of forces is obtained again. This increases the distance between the stationary element 18 and the moving element 16, thus enlarging the refrigerant path RP, to allow more refrigerant to flow between the stationary element 18 and the moving element 16 (FIG. 6). The refrigerant pressure therefore acts on the geometry of the refrigerant path RP through the diffuser 12, the increase of the pressure inducing enlargement of the geometry of the refrigerant path RP through the openings 14*a* and 14*b* so that more refrigerant flow passes in response to the pressure increase, as shown on FIG. 5.

If pressure P1 decreases, the moving element 16 will stay in place until the gravity force FG is above the pressure force FP. The moving element 16 is then lowered until the pressure difference and the balance of forces are obtained again, or until the diffuser 12 closes, if the pressure P1 has become too low.

For example, the pressure differential between P1 and P2 may be 100 kPa. The weight of the moving element 16 may be chosen as a function of the surface of the openings 14*a* in order to obtain a predetermined pressure differential.

At the outlet of the openings 14*a* of the stationary element 18, the refrigerant can go up through the openings 14*b* of the moveable element 16, then towards the shell 4, as shown by arrows RP on the FIGS. 5 and 6. In addition, at the outlet of the openings 14*a* of the stationary element 18, the refrigerant can go below the moveable element 16, directly towards the shell 4, as shown by the arrows oriented towards the left lower corner of FIGS. 5 and 6.

Figure 7:
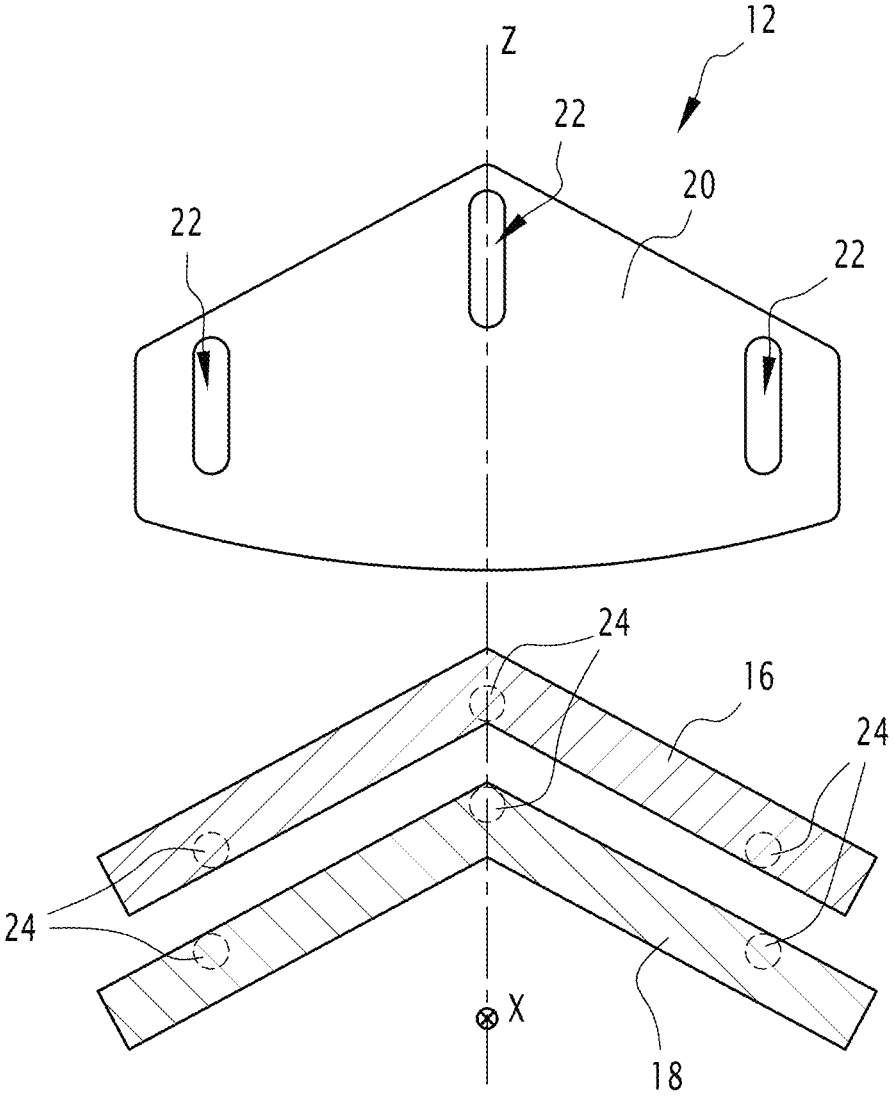
FIG. 7 is an exploded transversal sectional view of another embodiment of the diffuser.
Figure 8:
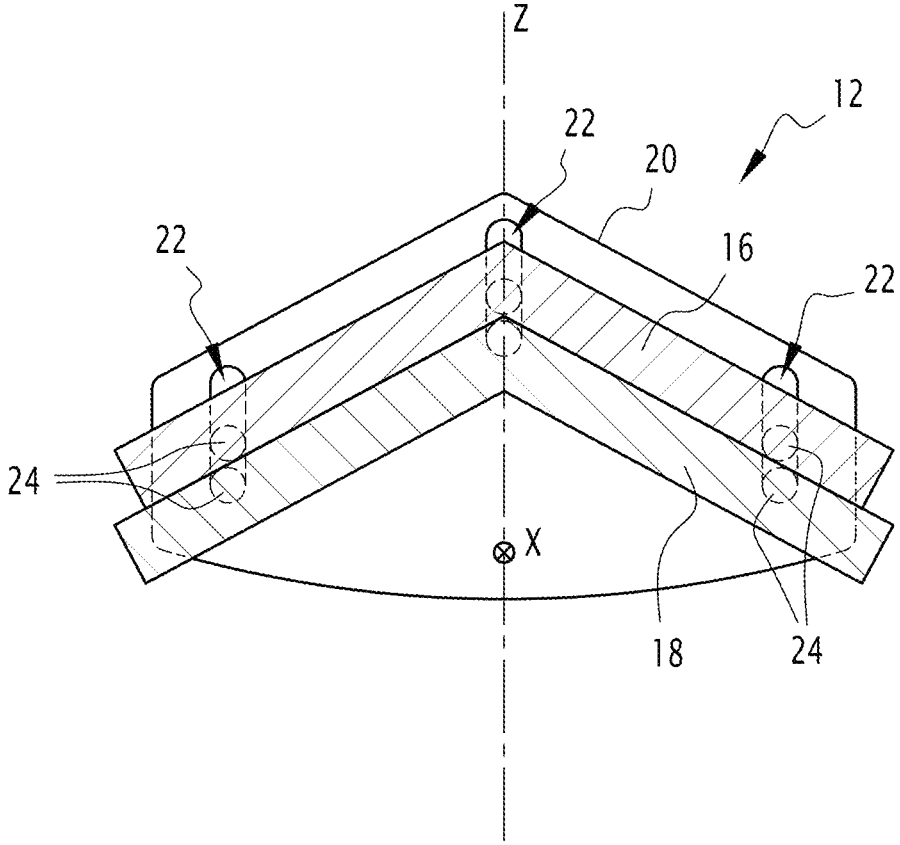
FIGS. 8 and 9 are transversal sectional views of the diffuser of FIG. 7 in closed and open configurations.
Figure 9:
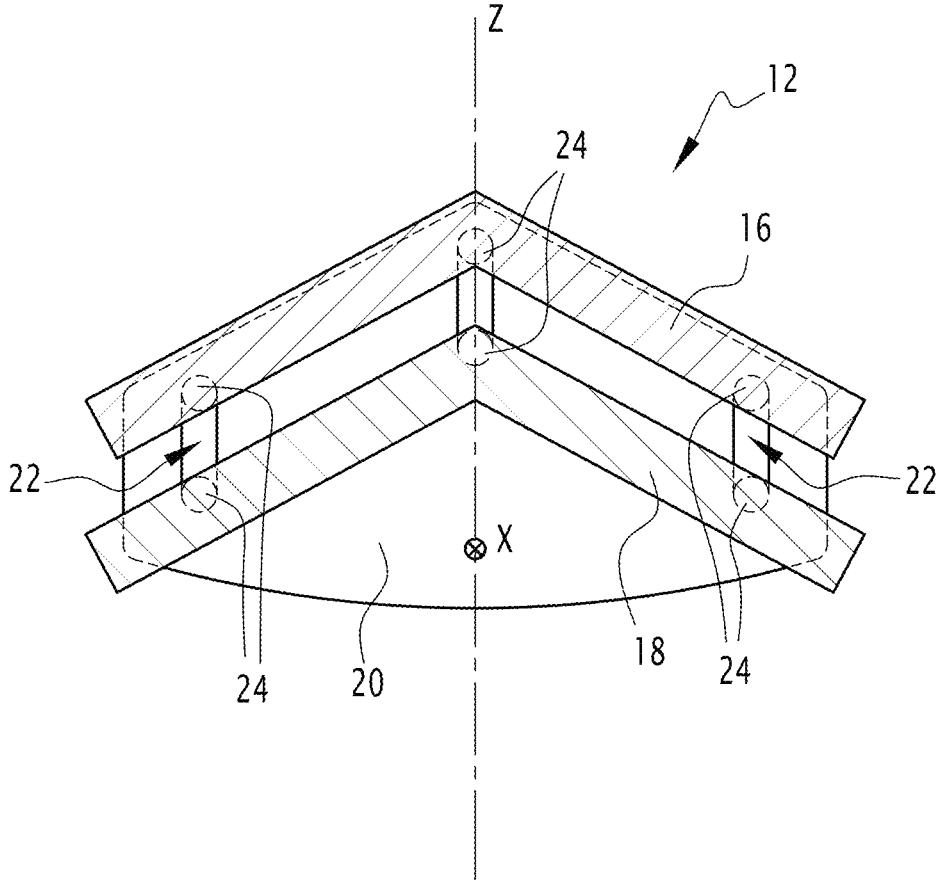

According to an embodiment shown in FIGS. 7 to 9, the diffuser 12 may comprise guiding elements for the movement of the moving element 16. The guiding elements may comprise flanges 20 located at the axial ends of the diffuser 12, and provided with rectilinear slots 22. The moving element 16 may comprise pins 24 inserted in the rectilinear slots 22 so that the pins slide in the rectilinear slots 22 to allow efficient guidance of the moving element 16 along its movement direction Z. The stationary element 18 may comprise similar pins 24 inserted in a fixed configuration in the rectilinear slots to make integral the flanges 20 and the stationary element 18.

Figure 10:
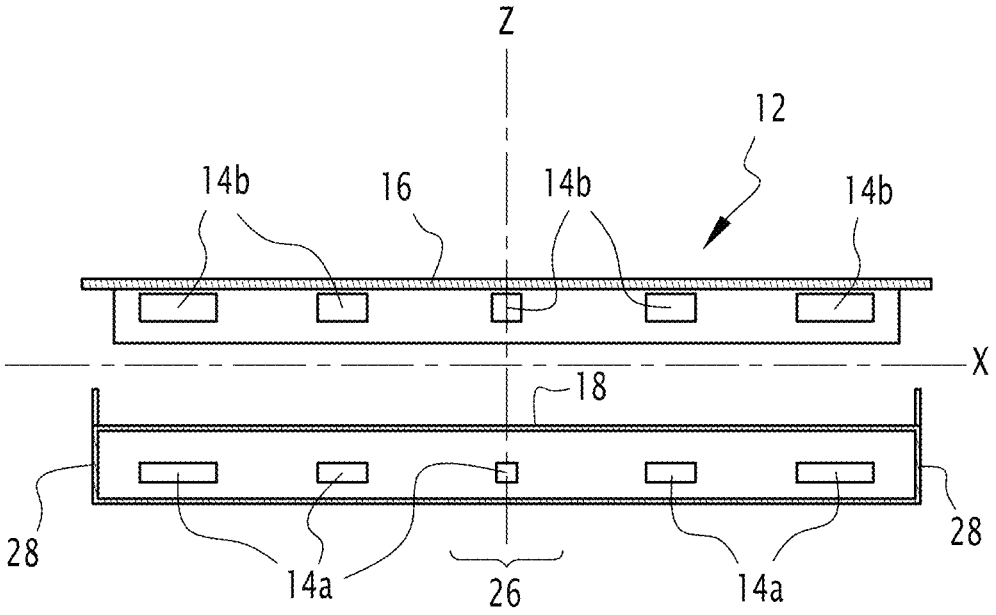
FIG. 10 is a view similar to FIG. 2, of another embodiment of the heat exchanger.

According to an embodiment represented on FIG. 10, the openings 14*a* and 14*b* may have increasing sizes along the longitudinal direction X of the diffuser 12, from a central area 26 of the diffuser 12 towards axial ends 28 of the diffuser 12. In the central area 26, the openings 14*a* and 14*b* have a smaller size, while away from the central area 26, the openings 14*a* and 14*b* have an enlarged size, and a maximal size in the vicinity of the axial ends 28.

The openings 14*a* and 14*b* may have a circular shape, as shown on FIG. 3, or a square or rectangular shape, as shown on FIG. 10.

The openings 14*a* and 14*b*, on the stationary element 18 and/or on the moving element 16, are not necessarily circular. They can have another shape.

The guiding means are not necessarily the ones shown as an example with references 20, 22 and 24. The notion of guides is not limited to this structure. The function of these guides is to guarantee that the moving element 16 is efficiently guided with respect to the stationary element 18.

Conical reliefs, or reliefs with any other shape, can be soldered, or fixed in any other way, to the moving element 16, in register with the openings 14*a* of the stationary element 18. This allows improved control of the flow section between the two elements 16 and 18 during the course of movement of the moving element.

According to non-shown embodiment, the diffuser 12 may have a shape different from the angled shape represented. In particular, the diffuser 12 is not necessarily V shaped. For example, half-cylindrical, flat or square shapes may be implemented while providing the same effects.

According to another non-shown embodiment, the diffuser 12 may comprise openings provided on the stationary element 18 only. In other words, the moving element 16 can be without openings. The refrigerant flows from the openings 14*a* of the stationary element 18, change direction on the movable element 16 and flows to the shell 4 below the moving element.

What is claimed is:

1. A heat exchanger (2) comprising a shell (4) extending along a longitudinal axis (X), an inlet pipe (6) and an outlet pipe (8), through which respectively enters (F1) and exits (F2) a refrigerant flow, and a bundle of pipes (10) crossing the shell (4) along the longitudinal axis (X), and comprising a refrigerant flow diffuser (12) provided inside the shell (4) downstream the inlet pipe (6), the refrigerant flow diffuser (12) extending along the longitudinal axis (X) and comprising openings (14*a*, 14*b*) through which the refrigerant flows, wherein the refrigerant flow diffuser (12) comprises a moving element (16) and a stationary element (18), the openings (14*a*, 14*b*) formed in both the moving element (16) and a stationary element (18), the moving element (16) being movable with respect to the stationary element (18) under action of a pressure force (FP) exerted by the refrigerant flow upstream of the refrigerant flow diffuser (12) so that the refrigerant flow going through the openings (14*a*, 14*b*) is adjusted and a differential refrigerant pressure between refrigerant pressure downstream (P2) and upstream (P1) the refrigerant flow diffuser (12) is kept constant;

wherein the pressure force (FP) is in an opposite direction of an effect of gravity on the moving element.

2. The heat exchanger according to claim 1, wherein the moving element (16) is movable along a vertical direction (Z), and the pressure force (FP) exerts upwards against a gravity force (FP) exerted on the moving element (16).

3. The heat exchanger according to claim 2, wherein in absence of the refrigerant flow through the diffuser (12), the moving element (16) is laid on the stationary element (18) closing the openings (14*a*, 14*b*).

4. The heat exchanger according to claim 3, wherein the openings (14*a*, 14*b*) are provided on the moving element (16) and the stationary element (18) in a shifted arrangement so that when the moving element (16) is laid on the stationary element (18), the openings (14*a*) of the stationary element (18) are closed by the moving element (16) while the openings (14*b*) of the moving element (16) are closed by the stationary element (18).

5. A heat exchanger (2) comprising a shell (4) extending along a longitudinal axis (X), an inlet pipe (6) and an outlet pipe (8), through which respectively enters (F1) and exits (F2) a refrigerant flow, and a bundle of pipes (10) crossing the shell (4) along the longitudinal axis (X), and comprising a refrigerant flow diffuser (12) provided inside the shell (4) downstream the inlet pipe (6), the refrigerant flow diffuser (12) extending along the longitudinal axis (X) and comprising openings (14*a*, 14*b*) through which the refrigerant flows, wherein the refrigerant flow diffuser (12) comprises a moving element (16) and a stationary element (18), the moving element (16) being movable with respect to the stationary element (18) under action of a pressure force (FP) exerted by the refrigerant flow so that the refrigerant flow going through the openings (14*a*, 14*b*) is adjusted and a differential refrigerant pressure between refrigerant pressure downstream (P2) and upstream (P1) the refrigerant flow diffuser (12) is kept constant;

wherein the refrigerant flow diffuser (12) has an angled shape, each of the moving element (16) and the stationary element (18) being formed by two angled plates (160, 162, 180, 182).

6. A heat exchanger (2) comprising a shell (4) extending along a longitudinal axis (X), an inlet pipe (6) and an outlet pipe (8), through which respectively enters (F1) and exits (F2) a refrigerant flow, and a bundle of pipes (10) crossing the shell (4) along the longitudinal axis (X), and comprising a refrigerant flow diffuser (12) provided inside the shell (4) downstream the inlet pipe (6), the refrigerant flow diffuser (12) extending along the longitudinal axis (X) and comprising openings (14*a*, 14*b*) through which the refrigerant flows, wherein the refrigerant flow diffuser (12) comprises a moving element (16) and a stationary element (18), the moving element (16) being movable with respect to the stationary element (18) under action of a pressure force (FP) exerted by the refrigerant flow so that the refrigerant flow going through the openings (14*a*, 14*b*) is adjusted and a differential refrigerant pressure between refrigerant pressure downstream (P2) and upstream (P1) the refrigerant flow diffuser (12) is kept constant;

wherein the refrigerant flow diffuser (12) comprises guides (20) for the movement of the moving element (16).

7. The heat exchanger according to claim 6, wherein the guides (20) comprise rectilinear slots (22), and wherein the moving element (16) comprises pins (24) inserted in the rectilinear slots (22) in a sliding manner.

8. The heat exchanger according to claim 1, wherein each of the moving element (16) and the stationary element (18) being formed by at least one plate.

9. The heat exchanger according to claim 1, wherein the openings (14*b*) formed in the moving element (16) are offset from the openings (14*a*) formed in the stationary element (18).

* * * * *